US010651557B2

(12) United States Patent
Ying et al.

(10) Patent No.: US 10,651,557 B2
(45) Date of Patent: May 12, 2020

(54) C-FED ANTENNA FORMED ON MULTI-LAYER PRINTED CIRCUIT BOARD EDGE

(71) Applicant: Sony Mobile Communications Inc., Tokyo (JP)

(72) Inventors: Zhinong Ying, Lund (SE); Kun Zhao, Stockholm (SE)

(73) Assignee: SONY MOBILE COMMUNICATIONS INC., Tokyo (JP)

( * ) Notice: Subject to any disclaimer, the term of this patent is extended or adjusted under 35 U.S.C. 154(b) by 0 days.

(21) Appl. No.: 16/307,244

(22) PCT Filed: Jun. 6, 2016

(86) PCT No.: PCT/EP2016/062768
§ 371 (c)(1),
(2) Date: Dec. 5, 2018

(87) PCT Pub. No.: WO2017/211378
PCT Pub. Date: Dec. 14, 2017

(65) Prior Publication Data

US 2019/0305429 A1 Oct. 3, 2019

(51) Int. Cl.
*H01Q 9/04* (2006.01)
*H01Q 5/378* (2015.01)
(Continued)

(52) U.S. Cl.
CPC ..... *H01Q 9/045* (2013.01); *H01Q 5/378* (2015.01); *H01Q 21/28* (2013.01); *H01Q 23/00* (2013.01); *H01Q 25/001* (2013.01); *H01Q 21/08* (2013.01)

(58) Field of Classification Search
CPC ..... H01Q 5/378; H01Q 5/385; H01Q 5/392; H01Q 9/0407; H01Q 9/045; H01Q 19/005
See application file for complete search history.

(56) References Cited

U.S. PATENT DOCUMENTS

2008/0284656 A1 11/2008 Petropoulos
2011/0057859 A1 3/2011 Rho
(Continued)

OTHER PUBLICATIONS

International Search Report and Written Opinion from counterpart International Patent Application No. PCT/EP2016/062768 dated Feb. 1, 2017, 13 pages.

*Primary Examiner* — Daniel Munoz
(74) *Attorney, Agent, or Firm* — Tucker Ellis LLP

(57) ABSTRACT

An antenna comprises an antenna patch (121) and an extension patch (125). The extension patch (125) is conductively coupled to the antenna patch (121) and is arranged in plane offset from the antenna patch (121). The antenna patch (121) is formed of multiple conductive strips (122A, 122B) extending in a horizontal direction along an edge of a multi-layer circuit board having multiple layers stacked along a vertical direction. Each of the conductive strips (122A, 122B) of the antenna patch (121) is arranged on a different layer of the multi-layer circuit board. The conductive strips (122A, 122B) of the antenna patch (121) are electrically connected to each other by conductive vias (123) extending between two or more of the conductive strips (122A. 122B) of the antenna patch (121), which are arranged on different layers of the multi-layer circuit board. Similarly, the extension patch (125) is formed of multiple conductive strips extending in the horizontal direction. Each of the conductive strips of the extension patch (125) is arranged on a different layer of the multi-layer circuit board. The conductive strips of the extension patch are electrically
(Continued)

connected to each other by conductive vias extending between two or more of the conductive strips of the extension patch, which are arranged on different layers of the multi-layer circuit board.

16 Claims, 6 Drawing Sheets

(51) Int. Cl.

| | |
|---|---|
| ***H01Q 21/28*** | (2006.01) |
| ***H01Q 23/00*** | (2006.01) |
| ***H01Q 25/00*** | (2006.01) |
| *H01Q 21/08* | (2006.01) |

(56) References Cited

U.S. PATENT DOCUMENTS

| | | | | |
|---|---|---|---|---|
| 2013/0207869 | A1 | 8/2013 | Han | |
| 2014/0028515 | A1 | 1/2014 | Lu | |
| 2014/0125541 | A1* | 5/2014 | Hong | H01Q 1/243 343/836 |
| 2016/0087348 | A1 | 3/2016 | Ko | |
| 2018/0309186 | A1* | 10/2018 | Yu | H01Q 1/243 |

* cited by examiner

C-FED ANTENNA FORMED ON MULTI-LAYER PRINTED CIRCUIT BOARD EDGE

FIELD OF THE INVENTION

The present invention relates to antennas, antenna devices with one or more antennas and communication devices equipped with such antenna device.

BACKGROUND OF THE INVENTION

In wireless communication technologies, various frequency bands are utilized for conveying communication signals. In order to meet increasing bandwidth demands, also frequency bands in the millimeter wavelength range, corresponding to frequencies in the range of about 10 GHz to about 100 GHz, are considered. For example, frequency bands in the millimeter wavelength range are considered as candidates for 5G ($5^{th}$ Generation) cellular radio technologies. However, an issue which arises with the utilization of such high frequencies is that antenna sizes need to be sufficiently small to match the wavelength. Further, in order to achieve sufficient performance, multiple antennas (e.g., in the form of an antenna array) may be needed in small sized communication devices, such as mobile phones, smartphones, or similar communication devices.

Further, since losses on cables or other wired connections within the communication device typically increase towards higher frequencies, it may also be desirable to have an antenna design in which the antenna can be placed very close to radio front end circuitry.

Further, it is desirable to have a compact antenna design which supports multiple polarizations.

Accordingly, there is a need for compact size antennas which can be efficiently integrated in a communication device.

SUMMARY OF THE INVENTION

According to an embodiment, an antenna is provided. The antenna comprises an antenna patch and an extension patch. The extension patch is conductively coupled to the antenna patch and is arranged in plane offset from the antenna patch. The antenna patch is formed of multiple conductive strips extending in a horizontal direction along an edge of a multi-layer circuit board having multiple layers stacked along a vertical direction. Each of the conductive strips of the antenna patch is arranged on a different layer of the multi-layer circuit board. The conductive strips of the antenna patch are electrically connected to each other by conductive vias extending between two or more of the conductive strips of the antenna patch, which are arranged on different layers of the multi-layer circuit board. The extension patch is formed of multiple conductive strips extending in the horizontal direction. Each of the conductive strips of the extension patch is arranged on a different layer of the multi-layer circuit board. The conductive strips of the extension patch are electrically connected to each other by conductive vias extending between two or more of the conductive strips of the extension patch, which are arranged on different layers of the multi-layer circuit board.

The multi-layer circuit board may be a multi-layer printed circuit board (multilayer PCB). Further, the multi-layer circuit board may be a multi-layer circuit board formed in a LTCC (low-temperature co-fired ceramic).

According to an embodiment, the conductive strips and the conductive vias of the antenna patch are arranged to form a mesh pattern. For example, the conductive strips and the conductive vias of the antenna patch may form a regular grid extending in a plane defined by the horizontal direction and the vertical direction.

Similarly, the conductive strips and the conductive vias of the extension patch may be arranged to form a mesh pattern. For example, the conductive strips and the conductive vias of the extension patch may form a regular grid extending in a plane defined by the horizontal direction and the vertical direction and offset from the plane of the antenna patch.

According to an embodiment, the extension patch is conductively coupled to the antenna patch by a common conductive strip which is part of the antenna patch and of the extension patch. This common conductive strip may be located on an edge of the antenna strip and the extension strip. Accordingly, the extension patch may have the form of a folded arm extending from one edge of the antenna patch.

According to an embodiment, the antenna further comprises an electrically floating parasitic patch, i.e., a patch which is merely capacitively coupled to the antenna patch and not conductively coupled to ground or some other fixed potential. The electrically floating parasitic patch is arranged in a further plane offset from the antenna patch, on a side opposite to the extension patch. The electrically floating parasitic patch is formed of multiple conductive strips extending in the horizontal direction. Each of the conductive strips of the electrically floating parasitic patch are arranged on a different layer of the multi-layer circuit board. The conductive strips of the electrically floating parasitic patch are electrically connected to each other by conductive vias extending between two or more of the conductive strips of the electrically floating parasitic patch, which are arranged on different layers of the multilayer circuit board. Accordingly, the antenna patch, the extension patch, and the parasitic patch may form a sandwich structure, with the antenna patch being sandwiched between the extension patch and the parasitic patch.

The conductive strips and the conductive vias of the electrically floating parasitic patch may be arranged to form a mesh pattern. For example, the conductive strips and the conductive vias of the electrically floating parasitic patch may form a regular grid extending in a plane defined by the horizontal direction and the vertical direction.

According to an embodiment, the electrically floating parasitic patch has a size which substantially corresponds to a size of the antenna patch. By choosing the size of the electrically floating parasitic patch (i.e., its dimension in the vertical and/or horizontal direction) and/or the distance between the antenna patch and the electrically floating parasitic patch, characteristics of the antenna can be tuned. By introducing the electrically floating parasitic patch, a bandwidth of the antenna can be increased as compared to a configuration without the electrically floating parasitic patch. By choosing the size of the electrically floating parasitic patch and/or the distance between the antenna patch and the electrically floating parasitic patch, the bandwidth can be tuned to a desired range.

According to an embodiment, the extension patch has a width in the horizontal direction which is smaller than a width of the antenna patch in the horizontal direction. If the antenna has a dual-polarization configuration, e.g., is configured for transmission of first radio signals polarized in the vertical direction and for transmission of second radio signals polarized in the horizontal direction, cross-polarization effects can be reduced.

According to an embodiment, a length of the extension patch in the vertical direction is selected depending on a wavelength of radio signal to by transmitted by the antenna. By choosing the vertical length of the extension patch and/or the distance between the antenna patch and the electrically floating parasitic patch, characteristics of the antenna can be tuned. Specifically, by introducing the extension patch, a resonant frequency of the antenna can be reduced as compared to a configuration without the extension patch. Accordingly, the antenna can be optimized for lower wavelengths without increasing the overall vertical dimension of the antenna, which is limited by a thickness of the multi-layer circuit board. By choosing the length of the extension patch and/or the distance between the antenna patch and the extension patch, the wavelengths supported by the antenna can be tuned to a desired range.

According to an embodiment, the antenna comprises two feeding points on the antenna patch, which are offset from each other in the horizontal direction and the vertical direction. In this way, the antenna can be provided with a dual-polarization configuration which supports transmission of first radio signals polarized in the vertical direction and for transmission of second radio signals polarized in the horizontal direction. The feeding points may be provided on conductive strips on different layers of the multi-layer circuit board.

According to an embodiment, the antenna is configured for transmission of radio signals having a wavelength of more than 1 mm and less than 3 cm, corresponding to frequencies of the radio signals in the range of 10 GHz to 300 GHz.

According to a further embodiment, a device is provided. The device comprises at least one antenna according to any one of the above embodiments and the multi-layer circuit board. Further, the device may comprise radio front end circuitry arranged on the multi-layer circuit board. The radio front end circuitry may for example include one or more amplifiers and/or one or more modulators for processing radio signals transmitted via the antennas. The device may for example correspond to an antenna module including multiple antennas. Further, the device may correspond to an antenna circuit package including one or more antennas and radio front end circuitry for feeding radio frequency signals to the antenna(s). According to an embodiment, the device may include an array of multiple antennas according to any one of the above embodiments.

If the device includes radio front end circuitry arranged on the multi-layer circuit board, the multi-layer circuit board may comprise a cavity in which the radio front end circuitry is received.

According to a further embodiment, a communication device is provided, e.g., in the form of a mobile phone, smartphone or similar user device. The communication device comprises a device according to any one of the above embodiments, i.e., a device including at least one antenna according to any one of the above embodiments and the multi-layer circuit board. Further, the communication device comprises at least one processor configured to process communication signals transmitted via the at least one antenna of the device.

The above and further embodiments of the invention will now be described in more detail with reference to the accompanying drawings.

DETAILED DESCRIPTION OF EMBODIMENTS

Figure 1:
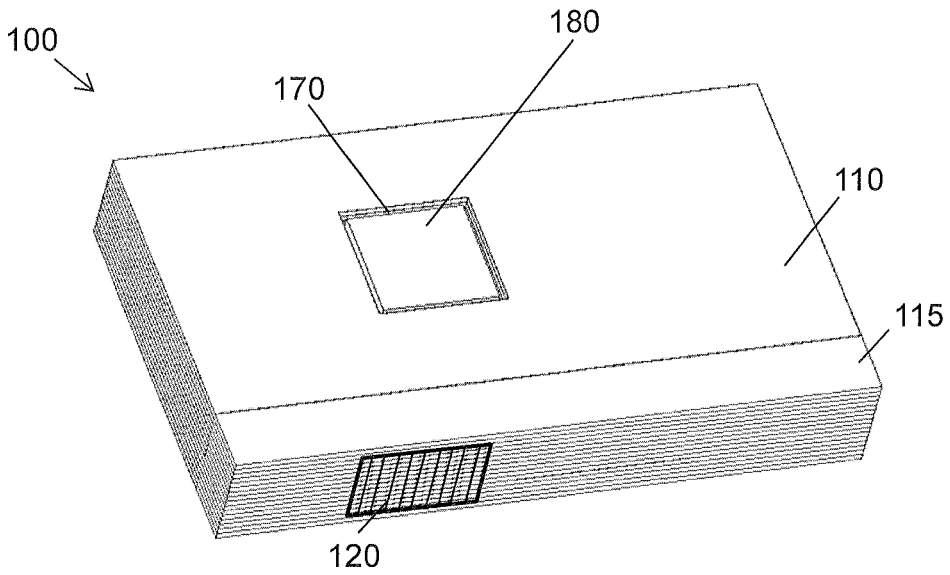
FIG. 1 shows a perspective view schematically illustrating an antenna device according to an embodiment of the invention.

In the following, exemplary embodiments of the invention will be described in more detail. It has to be understood that the following description is given only for the purpose of illustrating the principles of the invention and is not to be taken in a limiting sense, Rather, the scope of the invention is defined only by the appended claims and is not intended to be limited by the exemplary embodiments described hereinafter.

The illustrated embodiments relate to antennas for transmission of radio signals, in particular of short wavelength radio signals in the cm/mm wavelength range. The illustrated antennas and antenna devices may for example be utilized in communication devices, such as a mobile phone, smartphone, tablet computer, or the like.

In the illustrated concepts, a multi-layer circuit board is utilized for forming a patch antenna. The multi-layer circuit board has multiple layers stacked in a vertical direction. The layers of the multi-layer circuit board may be individually structured with patterns of conductive strips. In particular, conductive strips formed on different layers of the multi-layer circuit board may be connected to each other by conductive vias extending between the conductive strips of different layers to form an antenna patch and an extension patch which is conductively coupled to the antenna patch. Accordingly, the antenna patch and the extension patch may be formed to extend in the vertical direction, perpendicular to the planes of the layers of the multi-layer circuit board, thereby allowing a compact vertical antenna design. In this way, an antenna allowing for transmission of radio signals polarized in the vertical direction may be formed in an efficient manner. Further, one or more layers of the multi-layer circuit board may be utilized in an efficient manner for connecting the patch antenna to radio front end circuitry. Specifically, a small size of the patch antenna and short lengths of connections to the patch antenna may be achieved. Further, it is possible to integrate a plurality of such patch antennas on the multi-layer circuit board. Moreover, the patch antenna(s) can be efficiently provided with a dual-polarization configuration, supporting not only the transmission of radio signals polarized in the vertical direction, but also transmission of radio signals polarized in a horizontal direction, extending in the plane of the multi-layer circuit board. Accordingly, different polarization directions may be supported in a compact structure. In the embodiments as further detailed below, it will be assumed that the multilayer circuit board is a printed circuit board (PCB), based on structured metal layers printed on resin and fiber based substrate layers. However, it is noted that other multi-layer circuit packaging technologies could be used as well for forming the multi-layer circuit board, such as LTCC. The technology and materials used to form the multi-layer circuit board may also be chosen according to achieve desirable dielectric properties for supporting transmission of radio signals of a certain wavelength, e.g., based on the relation $$L = \frac{\lambda}{2\sqrt{\varepsilon_r}}, \tag{1}$$

where L denotes an effective dimension of the patch antenna, λ denotes the wavelength of the radio signals to be transmitted, and $\varepsilon_r$ denotes the relative permittivity of the substrate material of the multi-layer circuit board.

FIG. 1 shows a perspective view illustrating an antenna device 100 which is based on the illustrated concepts. In the illustrated example, the antenna device 100 includes a multi-layer PCB 110 and an antenna 120 formed in an edge region 115 of the multi-layer PCB 110. The multi-layer PCB 110 includes multiple PCB layers which are stacked in a vertical direction. The PCB layers may for example each correspond to a structured metallization layer on an isolating substrate. The antenna 120 is a patch antenna extending in a plane which is perpendicular to the PCB layers and parallel to one of the edges of the multi-layer PCB 110.

Further, the antenna device 100 includes a radio front end circuitry chip 180 which is arranged in a cavity 170 formed in the multi-layer PCB 110. Accordingly, electric connections from the radio front end circuitry chip 180 to the antenna 120 can be efficiently formed by conductive strips on one or more of the PCB layers. In particular, the electric connections may be formed with short lengths, so that signal losses at high frequencies can be limited. Further, one or more of the PCB layers may also be utilized for connecting the radio front end circuitry chip 180 to other circuitry, e.g., to power supply circuitry or digital signal processing circuitry.

Figure 2:
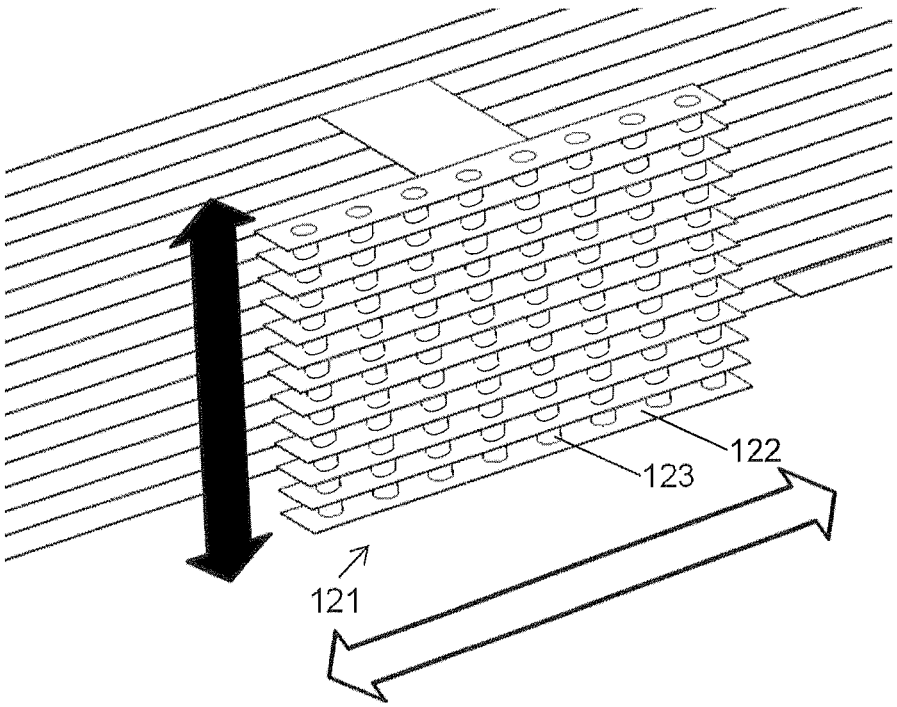
FIG. 2 shows a further perspective view for illustrating an antenna of the antenna device.

FIG. 2 further illustrates structures of the patch antenna 120. For this purpose, FIG. 2 does not show the isolating substrates of the PCB layers in the edge region 115 of the multi-layer PCB 110.

As can be seen, the patch antenna 120 includes an antenna patch 121 which extends in a plane which is perpendicular to the PCB layers and extends along the edge of the multi-layer PCB 110. The antenna patch 121 is formed of multiple conductive strips 122 on different PCB layers. The conductive strips 122 are stacked above each other in the vertical direction, thereby forming a three-dimensional superstructure. The conductive strips 122 of the different PCB layers are connected by conductive vias 123, e.g., metalized via holes. As illustrated, the conductive strips 122 and the conductive vias of the antenna patch 121 are arranged in a mesh pattern and form a substantially rectangular conductive structure extending the plane perpendicular to the PCB layers and in parallel to the edge of the multi-layer PCB 110. The grid spacing of the mesh pattern is selected to be sufficiently small so that, at the intended wavelength of the radio signals to be transmitted by the patch antenna 120, differences as compared to a uniform conductive structure are negligible. Typically, this can be achieved by a grid spacing of less than a quarter of the vertical and/or horizontal size of the antenna patch 121. It is noted that various kinds of grid structures may be utilized, e.g., based on an irregular spacing of the conductive strips 122 and regular spacing of the vias 123, based on regular spacings both in the horizontal direction and vertical direction, or based on irregular spacings both in the horizontal direction and vertical direction. It is noted that also vias 123 which are not-aligned in the vertical direction could be utilized in the grid structure. Further, it is noted that various numbers of the conductive strips 122 and/or vias 123 may be used.

Figure 3:
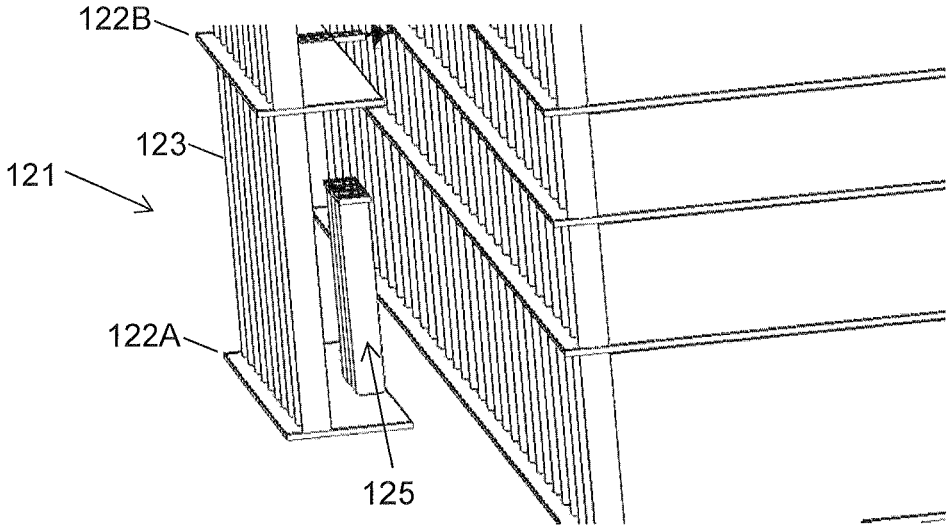
FIG. 3 shows a perspective view for schematically illustrating an antenna patch and an extension patch of the antenna.

In the illustrated example, the patch antenna 120 is configured for transmission of radio signals with a vertical polarization direction (illustrated by a solid arrow), i.e., a direction perpendicular to the PCB layers, and for transmission of radio signals with a horizontal polarization direction (illustrated by an open arrow), i.e., a direction parallel to the PCB layers and parallel to the edge of the multi-layer PCB 110. Accordingly, the patch antenna 120 is provided with a dual-polarization configuration. In the case of the horizontal polarization direction, the wavelength of the radio signals which can be transmitted by the antenna 120 is determined by an effective horizontal dimension of the antenna patch 121. For example, the horizontal width of the antenna patch 121 (measured along the edge of one of the PCB layers) may be used as the effective dimension L to determine the wavelength A of radio signals for which the antenna 120 is resonant. In the case of the vertical polarization direction, the wavelength of the radio signals which can be transmitted by the antenna 120 is determined by an effective vertical dimension of the antenna patch 121. For example, the vertical width of the antenna patch 121 (measured perpendicular to the PCB layers) may be used as the effective dimension L to determine the wavelength A of radio signals for which the antenna 120 is resonant. However, since the vertical width of the antenna patch 121 is limited by the thickness of the multi-layer PCB 110, the illustrated antenna 120 further includes an extension patch which has the purpose of extending the effective vertical dimension of the antenna patch 121 beyond its vertical width. An exemplary configuration of the antenna patch 121 and the extension patch is illustrated in FIG. 3. Similar to FIG. 2, FIG. 3 does not show the isolating substrates of the PCB layers in the edge region 115 of the multi-layer PCB 110. FIG. 3 shows two of the conductive strips 122 of the antenna patch 121, denoted by 122A and 122B, and the extension patch, denoted by 125.

As can be seen from FIG. 3, the extension patch 125 is formed in a similar manner as the antenna patch 121, i.e., of conductive strips on different PCB layers which are connected by conductive vias, e.g., metalized via holes. The extension patch 125 is conductively coupled to the antenna patch 121. In the illustrated example, the antenna patch 121 and the extension patch 125 share a common conductive strip 122A (in FIG. 3 shown as the bottommost conductive strip of the antenna patch 121). Accordingly, the extension patch 125 has the form of a folded arm extending from one edge of the antenna patch 121. When looking onto the edge of the multi-layer PCB 110, the extension patch 125 is located behind the antenna patch 121, which means that its influence on a radiation pattern of the antenna 120 is limited.

Figure 4:
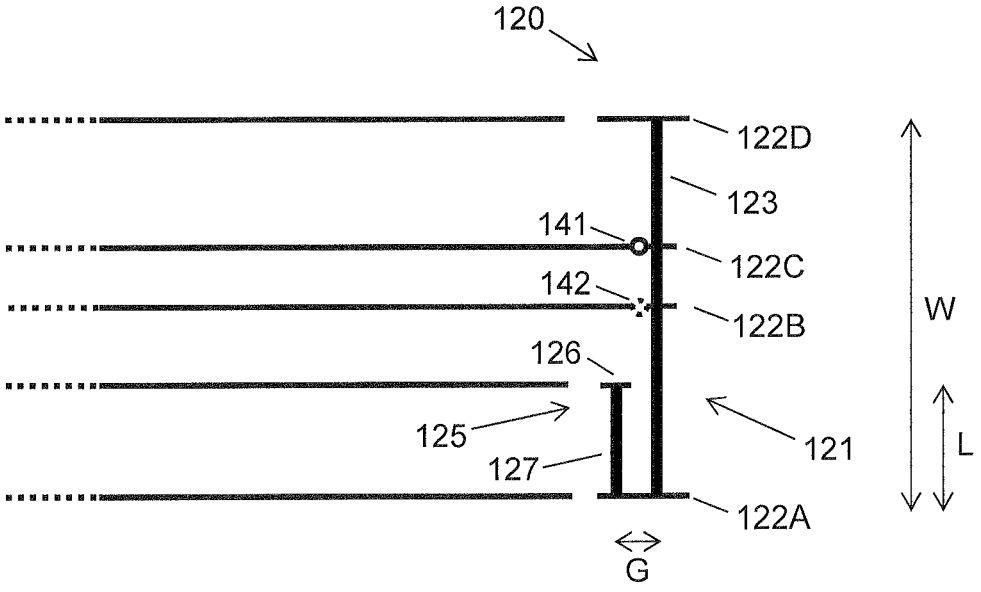
FIG. 4 shows a sectional view schematically illustrating configuration and dimensioning of the antenna patch and extension patch of the antenna.

FIG. 4 shows a schematic sectional view for illustrating configuration and dimensioning of the antenna 120, i.e., a view in a plane perpendicular to the horizontal direction. As can be seen, the extension patch 125 is formed of conductive strips 122A and 126, the conductive strip 122A being also part of the antenna patch 121, which is formed of the conductive strips 122A, 122B, 122C, 122D. Accordingly, conductive coupling of the extension patch 125 to the antenna patch 121 is accomplished through the conductive strip 122A. The conductive strips 122A and 126 are connected by conductive vias 127. Similar to the antenna patch 121, the conductive strips 122A, 126 and the conductive vias 127 of the antenna patch 121 may be arranged in a mesh pattern and form a substantially rectangular conductive structure extending the plane perpendicular to the PCB layers and in parallel to the edge of the multi-layer PCB 110. Also in this case, the grid spacing of the mesh pattern may be selected to be sufficiently small so that, at the intended wavelength of the radio signals to be transmitted by the antenna 120, differences as compared to a uniform conductive structure are negligible. It is noted that various kinds of grid structures may be utilized, e.g., based on an irregular spacing of the conductive strips 122A, 126 and regular spacing of the vias 127, based on regular spacings both in the horizontal direction and vertical direction, or based on irregular spacings both in the horizontal direction and vertical direction. It is noted that also vias 126 which are not-aligned in the vertical direction could be utilized in the grid structure. Further, it is noted that various numbers of the conductive strips and/or vias may be used in the extension patch.

As further shown in FIG. 4, the antenna patch 121 is connected at two feeding points 141, 142. At each of the feeding points 141, 142, an electrical connection to the radio front end circuitry chip 180 is provided. As illustrated the feeding points 141, 142 are formed on different PCB layers and thus offset from each other in the vertical direction. Similarly, the feeding points 141, 142 are offset from each other in the horizontal direction (i.e., a direction perpendicular to the drawing plane of FIG. 4). In the illustrated example, one of the feeding points is vertically centered on the antenna patch 121, while the other feeding point is horizontally centered on the antenna patch 121. Through the feeding points 141, 142, vertical and horizontal currents in the antenna patch 121 may be exited or detected independently from each other through electric signals at the feeding points 141, 142.

As further illustrated, the extension patch 125 is spaced by a distance G from the antenna patch 121. The antenna patch 121 has a dimension W along the vertical direction, and the extension patch 125 has a length L. As can be seen, the extension patch 125 increases the effective vertical dimension of antenna patch 121, namely to a length substantially corresponding to the vertical width W of the antenna patch 121 plus the vertical length of the extension patch 125 and the size G of the gap between the antenna patch 121 and the extension patch 125.

Figure 5:
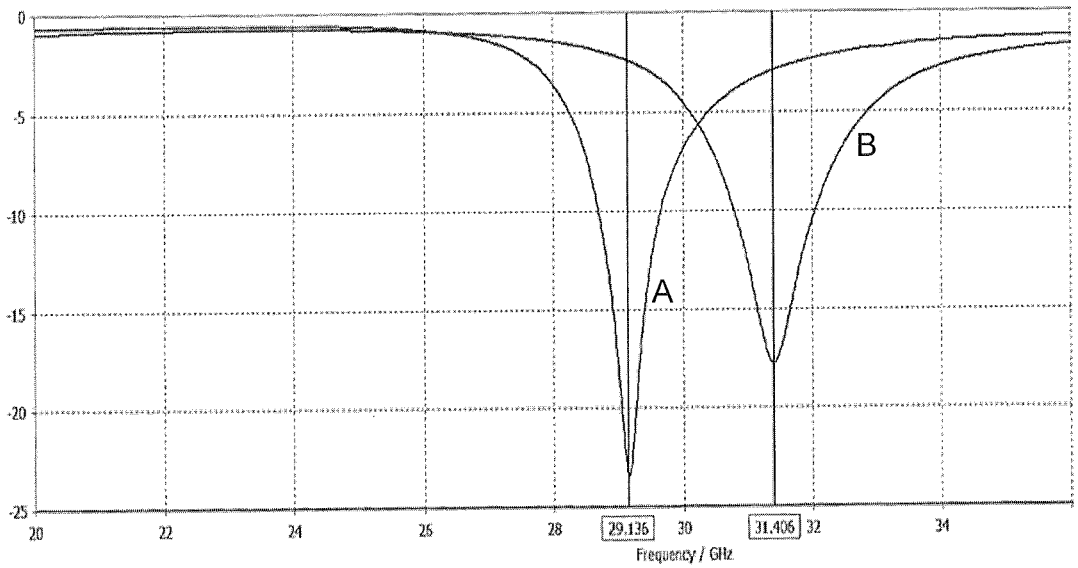
FIG. 5 shows a diagram for illustrating effects of the extension patch on characteristics of the antenna.

The distance G and the length L of the extension patch 125 may be set with the aim of optimizing the antenna for a certain wavelength range. In particular, by introducing the extension patch 125, the resonant frequency of the antenna 120 can be reduced as compared to a configuration without the extension patch 125, and the antenna 120 thus be optimized for radio signals of lower wavelength. FIG. 5 compares a frequency characteristic of an antenna with the extension patch (curve A) to a frequency characteristic of an antenna without the extension patch but otherwise similar configuration (curve B). For the simulations, a PCB of 2 mm thickness and 5 layers, and a relative permittivity of 3.55 of the substrate material was assumed. As regards the antenna geometry, a vertical width of the antenna patch 121 (width W of FIG. 4) of 2 mm, a horizontal width of the antenna patch 121 of 2.4 mm, a vertical length of the extension patch 125 (length L of FIG. 4) of 0.6 mm, a horizontal width of the extension patch of 0.6 mm, and a distance between the antenna patch 121 and the extension patch 125 (distance G of FIG. 4) of 0.1 mm was assumed. As can be seen, when the extension patch 125 is present (curve A), the antenna 120 has a lower resonant frequency and can thus be utilized for radio signals of longer wavelength.

Further, simulations using the above-mentioned configuration of the antenna 120 have shown that a good bandwidth, an almost uniform omnidirectional transmission characteristic, and a low cross-polarization level between horizontal direction and vertical direction can be achieved.

Accordingly, the vertical width W, the distance G, and the length L may be set according to the nominal wavelength of radio signals to be transmitted or received via the patch antenna 120, e.g., using relation (1) and assuming that the effective dimension L of the antenna patch 121 corresponds to the sum of the vertical width W, the length L, and the distance G. By using the extension patch 125, an optimization for longer wavelengths can be achieved by increasing the length L, without requiring an increase of the vertical width W (and thus the thickness of the multi-layer PCB 110).

Figure 6:
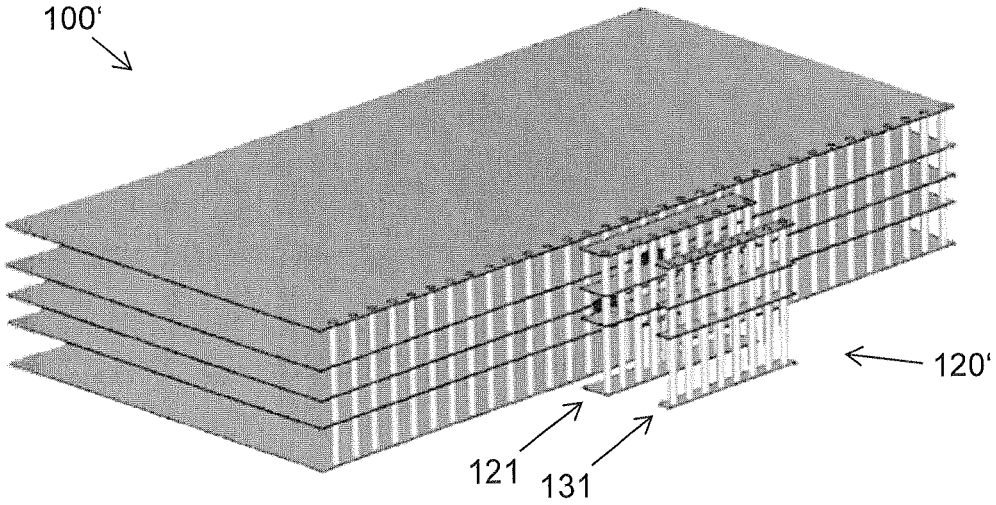
FIG. 6 shows a perspective view schematically illustrating an antenna device according to a further embodiment of the invention, which includes an antenna provided with an additional parasitic patch.

FIG. 6 shows a perspective view illustrating a further antenna device 100' which is based on the illustrated concepts. The antenna device 100' is generally similar to the above-described antenna device 100. The antenna device 100' includes an antenna 120' which in many aspects corresponds to the above-mentioned antenna 120. In particular, similar to the antenna 120, the antenna 120' is assumed to include the antenna patch 121 and the extension patch 125. In FIG. 6, structures which are similar to those of FIGS. 1 to 4 have been designated with the same reference signs, and details of such structures can also be taken from the above description in connection with FIGS. 1 to 5.

As illustrated, the antenna 120' differs from the antenna device 120 in that the antenna 120' further includes an electrically floating parasitic patch 131. The parasitic patch 131 is only capacitively coupled to the antenna patch 121 and without any conductive coupling to ground or some other fixed potential. The parasitic patch 131 is arranged in a plane offset from the antenna patch 121, on the opposite side of the extension patch 125. Accordingly, the antenna patch is sandwiched between the extension patch 125 and the parasitic patch 131. As can be seen from FIG. 6, the parasitic patch 131 is formed in a similar manner as the antenna patch 121 and the extension patch 125, i.e., of conductive strips 132 on different PCB layers which are connected by conductive vias 133, e.g., metalized via holes. When looking onto the edge of the multi-layer PCB 110, the parasitic patch 131 is located in front of the antenna patch 121, which means that it can be used to tune a radiation characteristics of the antenna 120'. Specifically, as compared to the antenna 120, the parasitic patch 131 allows for achieving a higher bandwidth for radio signals polarized in the vertical direction.

Figure 7:
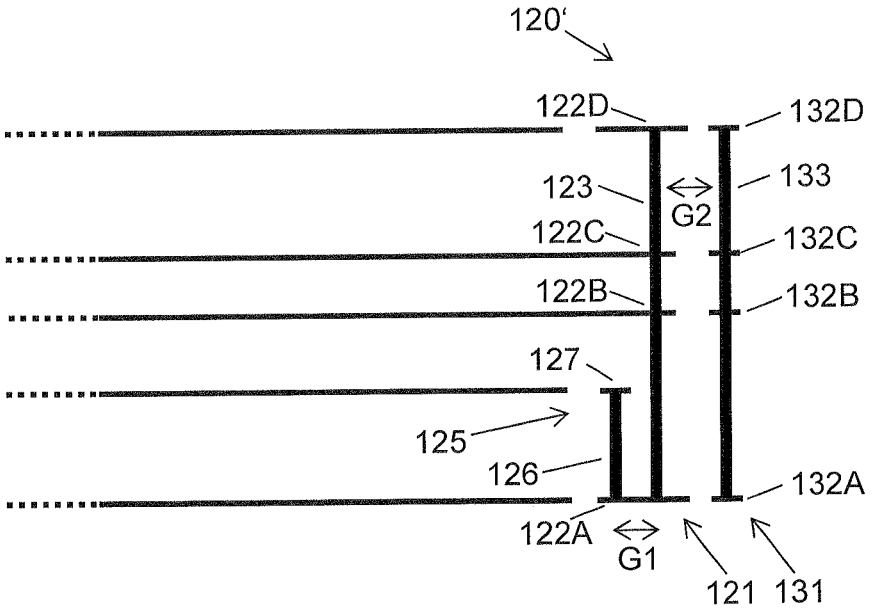
FIG. 7 shows a sectional view schematically illustrating configuration and dimensioning of the antenna patch, extension patch, and parasitic patch of the antenna.

FIG. 7 shows a schematic sectional view for illustrating configuration and dimensioning of the antenna 120', i.e., a view in a plane perpendicular to the horizontal direction. Similar to the antenna 120, the extension patch 125 is formed of conductive strips 122A and 126, the conductive strip 122A being also part of the antenna patch 121, which is formed of the conductive strips 122A, 122B, 122C, 122D. The parasitic patch 131 is formed of conductive strips 132A, 132B, 132C, 132D, which are connected by the conductive vias 133. It is noted that also in this case the two feeding points 141, 142 on the antenna patch 121 are present, but have been omitted from the illustration for the sake of a better overview.

Similar to the antenna patch 121, the conductive strips 132A, 132B, 132C, 132D and the conductive vias 133 of the parasitic patch 131 may be arranged in a mesh pattern and form a substantially rectangular conductive structure extending the plane perpendicular to the PCB layers and in parallel to the edge of the multi-layer PCB 110. Also in this case, the grid spacing of the mesh pattern may be selected to be sufficiently small so that, at the intended wavelength of the radio signals to be transmitted by the antenna 120', differences as compared to a uniform conductive structure are negligible. It is noted that various kinds of grid structures may be utilized, e.g., based on an irregular spacing of the conductive strips 132A, 132B, 132C, 132D and regular spacing of the vias 133, based on regular spacings both in the horizontal direction and vertical direction, or based on irregular spacings both in the horizontal direction and vertical direction. It is noted that also vias 133 which are not-aligned in the vertical direction could be utilized in the grid structure. Further, it is noted that various numbers of the conductive strips and/or vias may be used in the parasitic patch 131.

As further illustrated, the extension patch 125 is spaced by a distance G1 from the antenna patch 121. The parasitic patch 131 is spaced by a distance G2 from the antenna patch 121.

As in the case of the antenna 120, the distance G1 and the length L of the extension patch 125 may be set with the aim of optimizing the antenna 120' for a certain wavelength range. The distance G2 and the size of the parasitic patch 131 (e.g., vertical width and/or horizontal width) may be set to optimize the bandwidth of the antenna 120'. In a typical scenario, the vertical width and horizontal width of the parasitic patch 131 are similar to the vertical width and horizontal width of the antenna patch 121, i.e., the parasitic patch 131 has substantially the same size as the antenna patch 121. Simulations of the antenna 120' with the additional parasitic patch 131 have shown that an increased bandwidth of more than 1 GHz and a lowered cross-polarization level between horizontal direction and vertical direction of less than 15 dB can be achieved.

Figure 8:
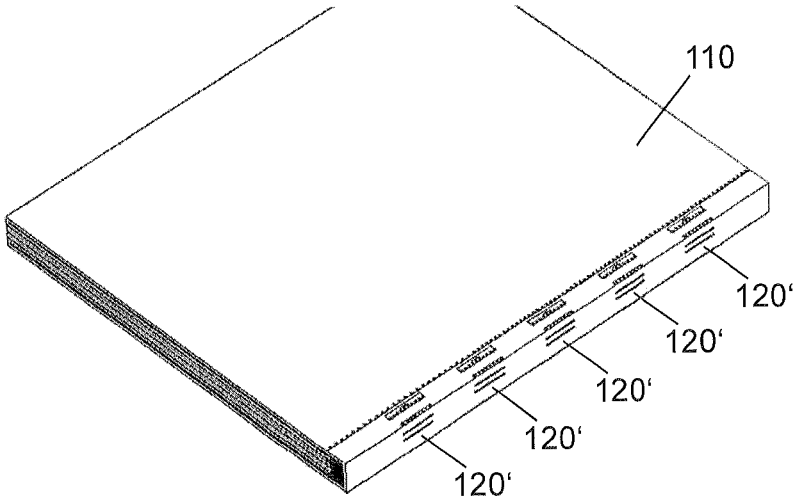
FIG. 8 shows a perspective view schematically illustrating an antenna device provided with an array of multiple antennas.

FIG. 8 further shows that the antenna device 100' may also provided with multiple instances of the antenna 120'. For example, the multiple antennas 120' may be used to form a phased antenna array (e.g., to be used for beamforming techniques). In the example of FIG. 8, the multiple antennas 120' are arranged along one of the edges of the multi-layer PCB 110. However, it is noted that would also be possible to arrange the multiple antennas 120' on two or more different edges of the multi-layer PCB 110. Further, it is noted that also multiple instances of the antenna 120 or a combination of one or more instances of the antenna 120 and one or more instances of the antenna 120' could be utilized. Further, lower or higher numbers of antennas could be utilized.

Figure 9:
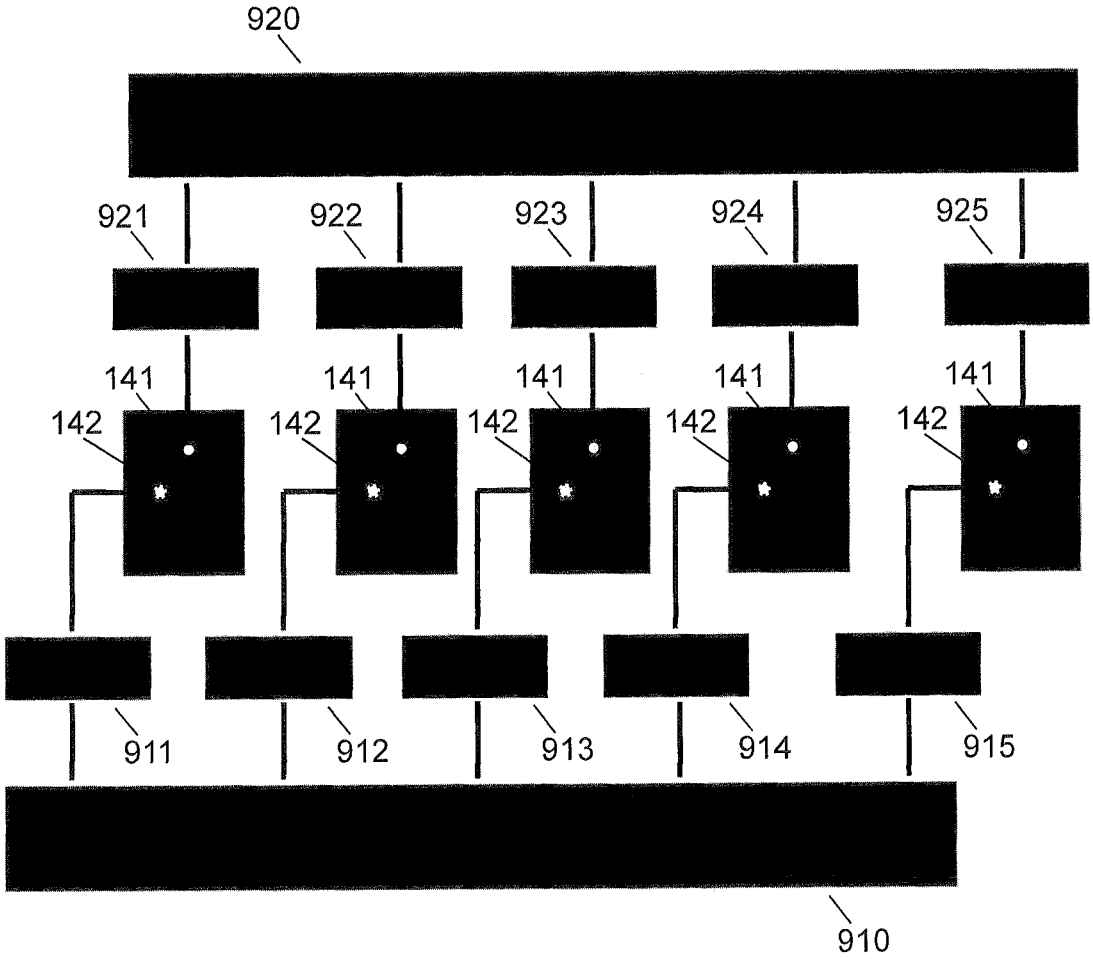
FIG. 9 schematically illustrates a circuit according to an embodiment of the invention, which may be applied for operating the array of multiple antennas in transmission of radio signals with different polarization.

FIG. 9 shows an example of a circuit which can be used to operate the phased antenna array. The circuit of FIG. 9 may be formed on one or more PCB layers of the multi-layer PCB. As illustrated, the circuit provides a horizontal polarization (H-pol) terminal 910 and a vertical polarization (V-pol) terminal 920. The horizontal polarization terminal 910 may be used for supplying signals corresponding to the horizontal polarization direction to the antennas 120'. Alternatively or in addition, the horizontal polarization terminal 910 may be used for receiving signals corresponding to the horizontal polarization direction from the antennas 120'. The vertical polarization terminal 920 may be used for supplying signals corresponding to the vertical polarization direction to the antennas 120'. Alternatively or in addition, the vertical polarization terminal 920 may be used for receiving signals corresponding to the vertical polarization direction from the antennas 120'. FIG. 9 also illustrates the feeding points 141, 142 on the individual antennas, through which the signals are supplied to the antennas 120' or received from the antennas 120'.

Further, the circuit includes a number of phase shifters 911, 912, 913, 914, 915, 921, 922, 923, 924, 925, one phase shifter corresponding to each antenna 120' and polarization direction. In particular, the phase shifter 911 provides a phase shift PhaseH1 for a first of the antennas 120' and the horizontal polarization direction, the phase shifter 912 provides a phase shift PhaseH2 for a second of the antennas 120' and the horizontal polarization direction, the phase shifter 913 provides a phase shift PhaseH3 for a third of the antennas 120' and the horizontal polarization direction, the phase shifter 914 provides a phase shift PhaseH4 for a fourth of the antennas 120' and the horizontal polarization direction, and the phase shifter 915 provides a phase shift PhaseH5 for a fifth of the antennas 120' and the horizontal polarization direction. Similarly, the phase shifter 921 provides a phase shift PhaseV1 for the first of the antennas 120' and the vertical polarization direction, the phase shifter 922 provides a phase shift PhaseV2 for the second of the antennas 120' and the vertical polarization direction, the phase shifter 923 provides a phase shift PhaseV3 for the third of the antennas 120' and the vertical polarization direction, the phase shifter 924 provides a phase shift PhaseV4 for the fourth of the antennas 120' and the vertical polarization direction, and the phase shifter 925 provides a phase shift PhaseV5 for the fifth of the antennas 120' and the vertical polarization direction. By controlling the phase shifts applied by the phase shifters 911, 912, 913, 914, 915, 921, 922, 923, 924, 925, a directivity of the phased antenna array may be controlled, e.g., in terms of transmission direction, reception direction, beam width, or the like. This may be accomplished independently for the horizontal polarization direction and the vertical polarization direction.

Figure 10:
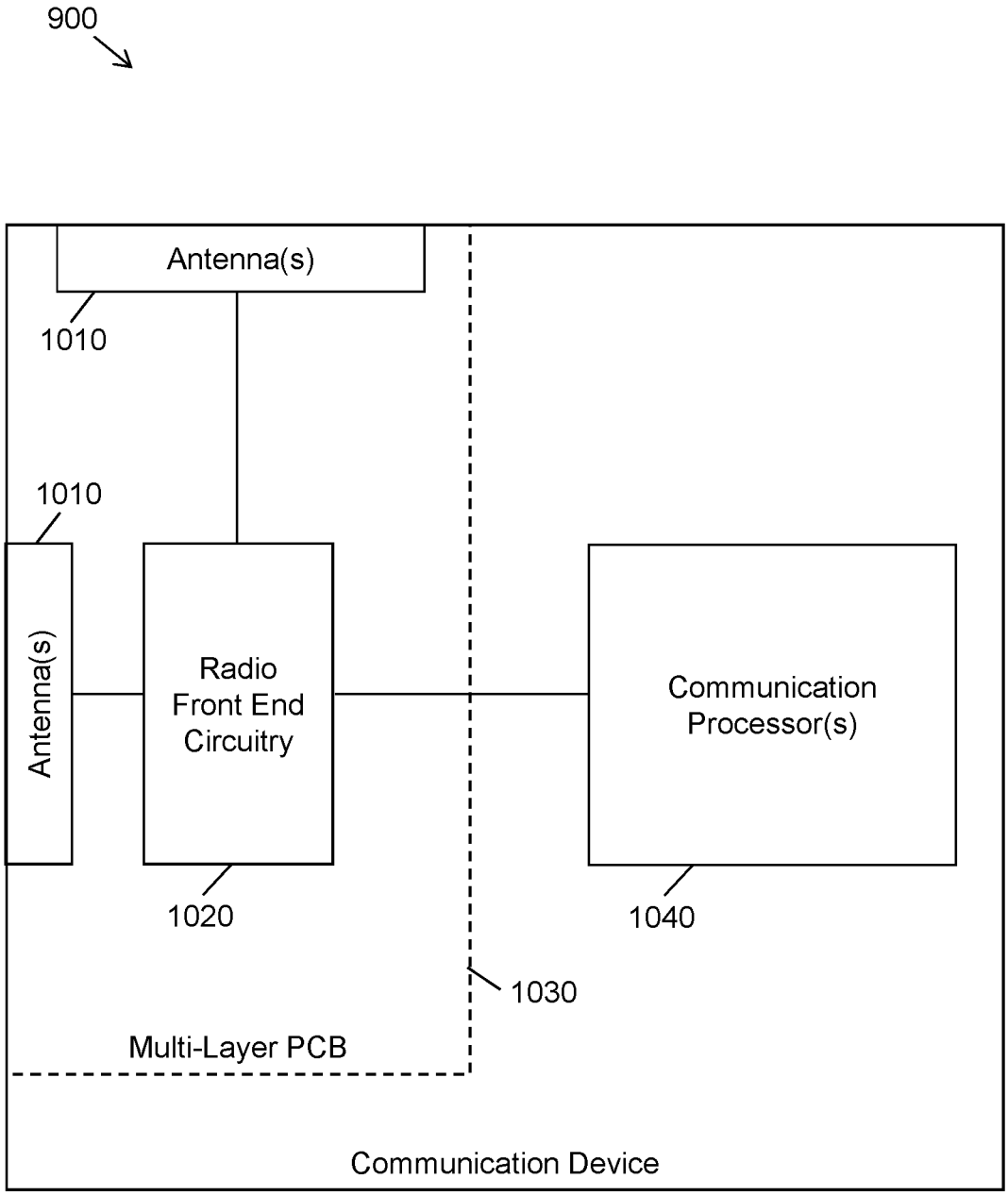
FIG. 10 shows a block diagram for schematically illustrating a communication device according to an embodiment of the invention.

FIG. 10 schematically illustrates a communication device 1000 which is equipped with an antenna device as explained above, e.g., with the antenna device 100 or the antenna device 100'. The communication device may correspond to a small sized user device, e.g., a mobile phone, a smartphone, a tablet computer, or the like. However, it is to be understood that other kinds of communication devices could be used as well, e.g., vehicle based communication devices, wireless modems, or autonomous sensors.

As illustrated, the communication device 1000 includes one or more antennas 1010. These antennas 1010 include at least one antenna of the above-mentioned patch antenna type, such as the antenna 120 or the antenna 120'. Further, the communication device 1000 may also include other kinds of antennas. Using concepts as explained above, the antennas 1010 are integrated together with radio front end circuitry 1020 on a multi-layer circuit board 1030, such as the above-mentioned multi-layer PCB 110. As further illustrated, the communication device 1000 also includes one or more communication processor(s) 1040. The communication processor(s) 1040 may generate or otherwise process communication signals for transmission via the antennas 1010, For this purpose, the communication processor(s) 1040 may perform various kinds of signal processing and data processing according to one or more communication protocols, e.g., in accordance with a 5G cellular radio technology.

It is to be understood that the concepts as explained above are susceptible to various modifications. For example, the concepts could be applied in connection with various kinds of radio technologies and communication devices, without limitation to a 5G technology. The illustrated antennas may be used for transmitting radio signals from a communication device and/or for receiving radio signals in a communication device. Further, it is to be understood that the illustrated antenna structures may be subjected to various modifications concerning antenna geometry. For example, the illustrated rectangular antenna patch shapes could be modified to more complex shapes.

The invention claimed is:

1. An antenna, comprising an antenna patch;

an extension patch conductively coupled to the antenna patch and arranged in plane offset from the antenna patch; and an electrically floating parasitic patch, capacitively coupled to the antenna patch and arranged in a further plane offset from the antenna patch on a side opposite to the extension patch, the antenna patch being formed of multiple conductive strips extending in a horizontal direction along an edge of a multi-layer circuit board having multiple layers stacked along a vertical direction, each of the conductive strips of the antenna patch being arranged on a different layer of the multi-layer circuit board, the conductive strips of the antenna patch being electrically connected to each other by conductive vias extending between two or more of the conductive strips of the antenna patch, which are arranged on different layers of the multi-layer circuit board, the extension patch being formed of multiple conductive strips extending in the horizontal direction, each of the conductive strips of the extension patch being arranged on a different layer of the multi-layer circuit board, the conductive strips of the extension patch being electrically connected to each other by conductive vias extending between two or more of the conductive strips of the extension patch, which are arranged on different layers of the multi-layer circuit board, the electrically floating parasitic patch being formed of multiple conductive strips extending in the horizontal direction, each of the conductive strips of the electrically floating parasitic patch being arranged on a different layer of the multi-layer circuit board, and the conductive strips of the electrically floating parasitic patch being electrically connected to each other by conductive vias extending between two or more of the conductive strips of the electrically floating parasitic patch, which are arranged on different layers of the multi-layer circuit board.

2. The antenna according to claim 1, wherein the conductive strips and the conductive vias of the antenna patch are arranged to form a mesh pattern.

3. The antenna according to claim 1, wherein the conductive strips and the conductive vias of the extension patch are arranged to form a mesh pattern.

4. The antenna according to claim 1, wherein the extension patch is conductively coupled to the antenna patch by a common conductive strip which is part of the antenna patch and of the extension patch.

5. The antenna according to claim 1, wherein the electrically floating parasitic patch has a size which substantially corresponds to a size of the antenna patch.

6. The antenna according to claim 1, wherein the extension patch has a width in the horizontal direction which is smaller than a width of the antenna patch in the horizontal direction.

7. The antenna according to claim 1, wherein a length of the extension patch in the vertical direction is selected depending on a wavelength of radio signal to be transmitted by the antenna.

8. The antenna according to claim 1, comprising:

two feeding points on the antenna patch which are offset from each other in the vertical direction and the horizontal direction.

9. The antenna according to claim 1, wherein the antenna is configured for transmission of radio signals having a wavelength of more than 1 mm and less than 3 cm.

10. A device, comprising, at least one antenna according to claim 1; and the multi-layer circuit board.

11. The device according to claim 10, wherein the antenna comprises an array of multiple antennas.

12. The device according to claim 10, comprising:

radio front end circuitry arranged on the multi-layer circuit board.

13. The device according to claim 10, wherein the multi-layer circuit board comprises a cavity in which radio front end circuitry is received.

14. A communication device, comprising:

a device according to claim 10; and at least one processor configured to process communication signals transmitted via the at least one antenna of the device.

15. The antenna of claim 1, wherein the extension patch is positioned behind the antenna patch when viewed along a direction extending into the edge of the multi-layer circuit board.

16. The antenna of claim 1, wherein the electrically floating parasitic patch is positioned in front of the antenna patch when viewed along a direction extending into the edge of the multi-layer circuit board.

* * * * *